US012396547B1

(12) United States Patent
Seaman

(10) Patent No.: US 12,396,547 B1
(45) Date of Patent: Aug. 26, 2025

(54) COMBINATION CHAIR BACKPACK

(71) Applicant: Jerry R. Seaman, Fairmount, IL (US)

(72) Inventor: Jerry R. Seaman, Fairmount, IL (US)

( * ) Notice: Subject to any disclaimer, the term of this patent is extended or adjusted under 35 U.S.C. 154(b) by 19 days.

(21) Appl. No.: 18/982,698

(22) Filed: Dec. 16, 2024

Related U.S. Application Data

(60) Provisional application No. 63/616,256, filed on Dec. 29, 2023.

(51) Int. Cl.
*A45F 4/02* (2006.01)
*A45F 3/08* (2006.01)

(52) U.S. Cl.
CPC ..... *A45F 4/02* (2013.01); *A45F 3/08* (2013.01); *A45F 2004/026* (2013.01)

(58) Field of Classification Search
CPC ..... A45F 4/00; A45F 4/02; A45F 2004/006; A45F 2004/026; A45F 3/08
USPC ..... 224/155
See application file for complete search history.

(56) References Cited

U.S. PATENT DOCUMENTS

| | | | | | |
|---|---|---|---|---|---|
| 3,266,686 | A * | 8/1966 | Griffith | A45F 4/02 | 224/155 |
| 4,286,739 | A * | 9/1981 | Silcott | A45F 4/02 | 224/155 |
| 5,209,381 | A * | 5/1993 | Jay | A47C 4/52 | 224/155 |
| 5,533,654 | A * | 7/1996 | Holty | A45F 3/04 | 224/155 |
| 5,588,696 | A * | 12/1996 | Jay | A47C 4/52 | 224/155 |
| 10,080,419 | B2 * | 9/2018 | Wolffe | A45F 3/04 | |
| 10,321,750 | B2 * | 6/2019 | Solomon | A47C 4/28 | |
| 2019/0045908 | A1 * | 2/2019 | Zhu | A45F 3/14 | |
| 2021/0186188 | A1 * | 6/2021 | Davies | A47C 17/82 | |
| 2022/0175140 | A1 * | 6/2022 | Lee | A47C 7/628 | |

FOREIGN PATENT DOCUMENTS

KR 200329794 Y1 * 10/2003

* cited by examiner

*Primary Examiner* — Scott T McNurlen
(74) *Attorney, Agent, or Firm* — Philip L Bateman

(57) ABSTRACT

A combination chair backpack is carried as a backpack and is converted into a chair without the user having to manually unfold the chair while standing beside it. The combination chair backpack has a backrest portion and a seat portion connected by a hinge. A backpack-position cord raises and lowers the seat portion and also engages a latch securing the seat portion in the backpack position. A chair-position cord releases a latch securing the hinge in the chair position.

2 Claims, 6 Drawing Sheets

COMBINATION CHAIR BACKPACK

CROSS-REFERENCE TO RELATED APPLICATION

This application claims the benefit of U.S. Provisional Patent Application Ser. No. 63/616,256, Dec. 29, 2023.

FIELD OF THE INVENTION

The invention relates to chairs and backpacks.

BACKGROUND OF THE INVENTION

A variety of folding chairs suitable for carrying to a remote location are known. One type commonly known as a lawn chair features a seat and back rest that fold against each other. Lawn chair typically have an aluminum frame with plastic web straps forming the seat and the back rest. Lawn chairs are commonly carried with the hands along the sides of the body. A second type of folding chair is commonly known as a quad camping chair. Quad camping chairs fold into four sections to form a cylindrical assembly that fits into a cylindrical carrying bag with a shoulder strap. Quad camping chairs typically have a one piece fabric section that extends between the front of the seat and the top of the back rest.

With both types of folding chair, the user unfolds the chair while standing and then sits down into the unfolded chair. There are some situations where the unfolding process is undesirable. For example, when a hunter is walking through a field or forest and sees game, he would often like to sit down into a chair to aim his weapon or to wait for the game to get closer. Unfolding a conventional folding chair while standing beside it involves so much motion that it attracts the attention of the game and allows it to get away.

Accordingly, a demand exists for an improved folding chair. A more particular object is to provide a combination chair backpack that is carried like a backpack and is converted into a chair while on the back of the user.

SUMMARY OF THE INVENTION

The general object of this invention is to provide an improved folding chair. A more particular object is to provide a combination chair backpack that is carried like a backpack and is converted into a chair while on the back of the user.

I have invented a combination chair backpack comprising: (a) a vertical and stationary backrest portion having a front with shoulder straps for placement over the shoulders of a user and having a back; (b) a seat portion movable in an arc of about 270 degrees between a vertical backpack position and a horizontal chair position, the seat portion having a top adapted for sitting upon by the user and having a bottom with folding legs, a backpack-position latch for securing the seat portion in the backpack position, and a backpack-position release; (c) a hinge connecting the backrest portion and the seat portion, the hinge having a backpack position in which the back of the backrest portion is parallel to and facing the bottom of the seat portion, the hinge having a chair position in which the backrest portion is perpendicular to the seat portion, and the hinge having a chair-position latch for securing the hinge in the chair position; (d) a backpack-position cord running from the backpack-position release, through the backrest portion, and to an accessible position for the user for lowering the seat portion from the vertical backpack position to the horizontal chair position, for raising the seat portion from the horizontal chair position to the vertical backpack position to engage the backpack-position latch for securing the seat portion in the backpack position, and for releasing the backpack-position release; and (e) a chair-position cord running from the chair-position latch, through the backrest portion, and to an accessible position for the user for releasing the chair-position latch to enable the seat portion to move from the chair position to the backpack position.

The combination chair backpack of this invention is carried as a backpack and converts into a chair while on the back of the user and without the user having to manually unfold the chair while standing beside it.

DETAILED DESCRIPTION OF THE INVENTION

Figure 1B:
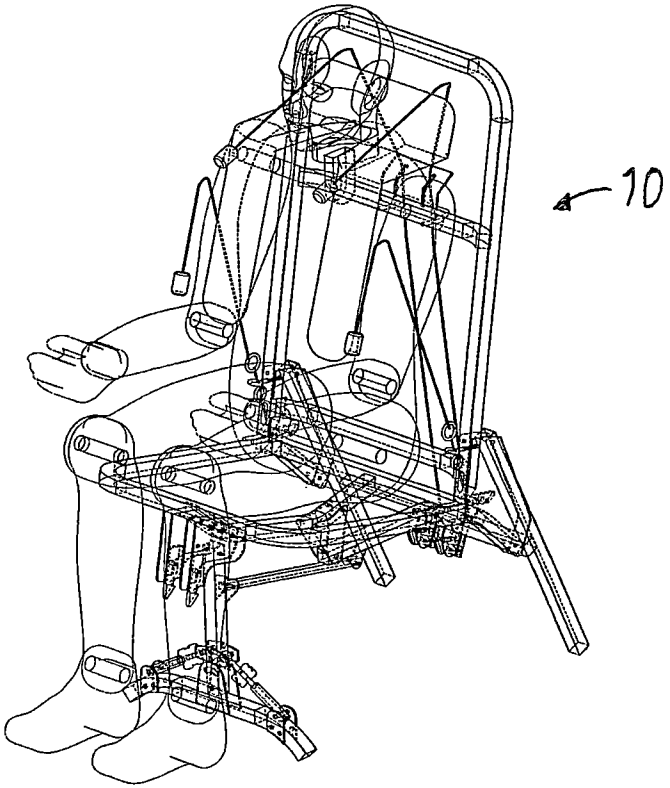
FIG. 1B is a perspective view thereof.

This invention is best understood by the reference to the drawings of the preferred embodiment of the combination chair backpack 10. The apparatus contains a backrest portion 20, a seat portion 30, a hinge 40, a backpack-position cord 50, and a chair-position cord 60. The apparatus is carried by a user 70. The components are discussed in detail below.

The backrest portion 20 is vertically oriented and is carried with the front of the backrest portion flush against the back of the user. The backrest portion is relatively stationary in that it remains against the back of the user at all times. However, it does have a backpack position in which it rests slightly higher on the back than in the chair position. The backrest portion has shoulder straps 21 extending from its front. The shoulder straps pass over the shoulders of the user for carrying the apparatus. As explained in more detail, below, the backrest portion preferably has a cam cleat lock 22 at its side for securing the chair-position cord. The size and construction of the backrest portion are matters of choice. In general, the comfort and the weight of the backrest portion increase as the size and cushioning increase. A backrest portion having an aluminum frame with a width of about 12 to 18 inches, a height of about 24 to 36 inches, with webbing or padding between the frame is a good compromise between comfort and weight. Unless otherwise indicated expressly or by context, the term "about" is used herein to mean plus or minus 25 percent of the measurement or other quantified property referenced.

Figure 1C:
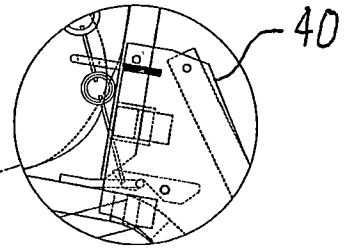
FIG. 1C is a detail of the chair-position latch thereof.
Figure 1A:
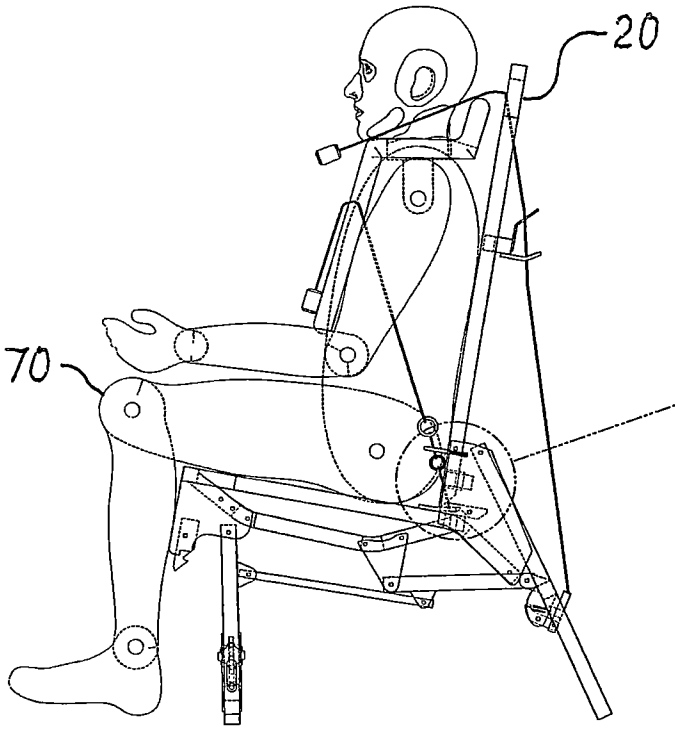
FIG. 1A is a side elevation view of a preferred embodiment of the combination chair backpack of this invention in a first chair position with a user shown in broken lines.
Figure 6B:
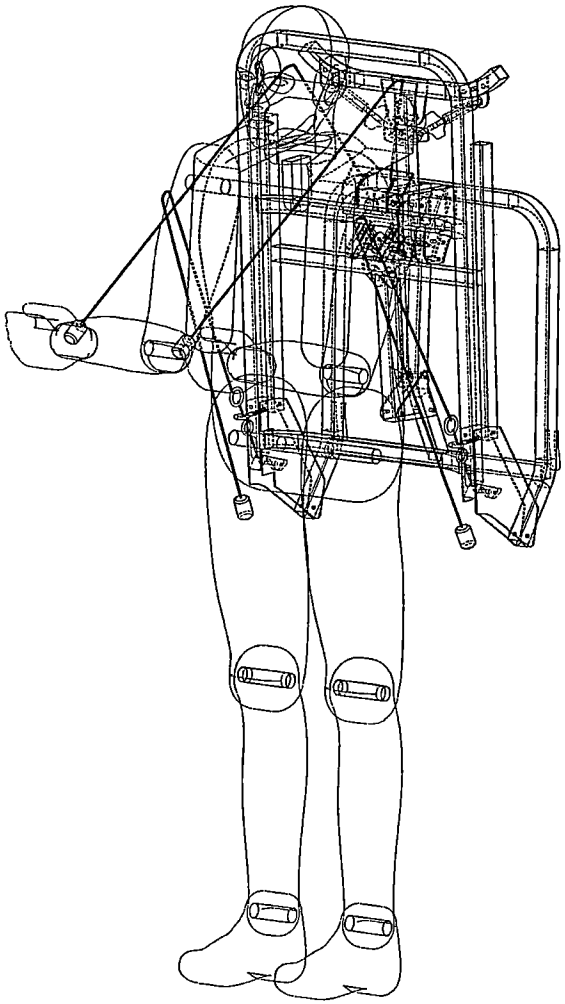
FIG. 6B is a perspective view thereof.
Figure 6C:
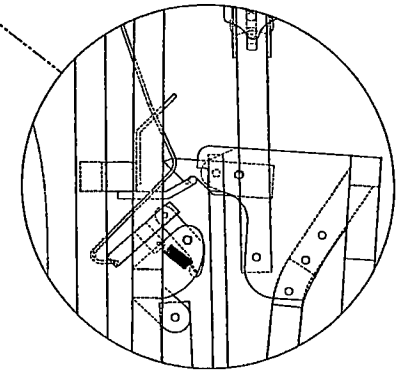
FIG. 6C is a detail of the latch thereof.
Figure 6A:
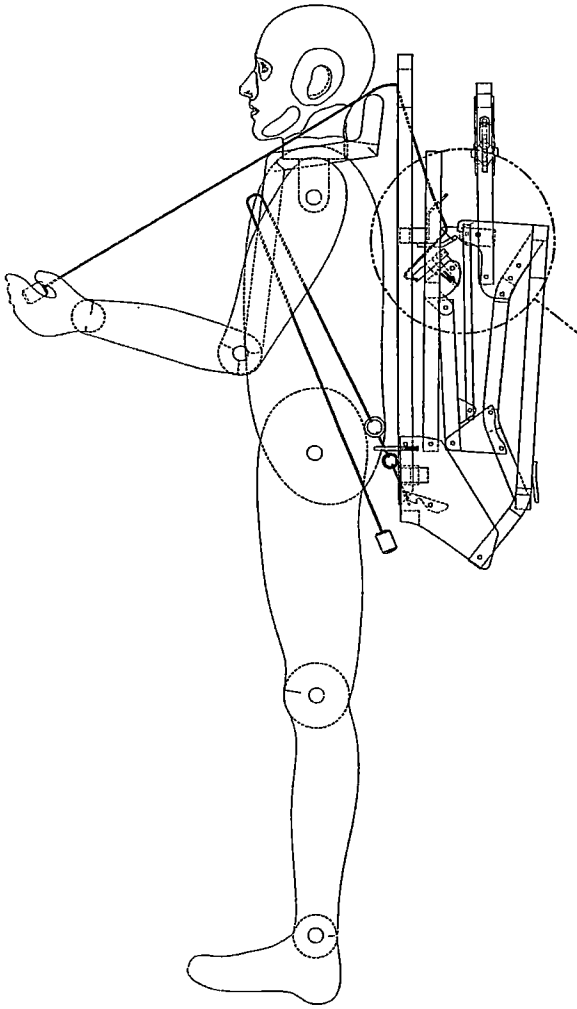
FIG. 6A is a side elevation view thereof in the backpack position.

The seat portion 30 moves in an arc of about 270 degrees between the horizontal chair position shown in FIGS. 1A to 1C and the vertical backpack position shown in FIGS. 6A to 6C. The top of the seat portion faces upward in the chair position and faces away from the user in the backpack position. The size and construction of the seat portion are matters of choice. As with the backrest portion, the comfort and the weight of the seat portion increase as the size and cushioning increase. A seat portion having an aluminum frame with a width of about 12 to 18 inches, a depth of about 12 to 18 inches, with webbing or padding between the frame is a good compromise between comfort and weight. Legs 31 extend from the bottom of the seat portion. The legs fold upwardly as the seat portion moves into the backpack position. The front leg is linked to the back legs so they fold together.

The bottom of the seat portion contains a backpack-position release 32 and a backpack-position latch 33 for holding the seat portion in the backpack position. While a single backpack-position release and a single latch are suitable, a pair of spaced apart backpack-position releases and latches is preferred.

If desired, storage compartments are attached to the seat portion. Storage compartments enable the combination chair backpack to perform the storage function of a conventional backpack.

The hinge 40 connects the backrest portion to the seat portion. The hinge also enables the seat portion to move relative to the backrest portion. More particularly, the hinge enables the seat portion to move in an arc of about 270 degrees between the horizontal chair position shown in FIGS. 1A to 1C and the vertical backpack position shown in FIGS. 6A to 6C. When the seat portion is in the horizontal chair position, it is perpendicular to the backrest portion. When the seat portion is in the vertical backpack position, it is parallel to the backrest portion with the back of the backrest portion facing the bottom of the seat portion and with the folded legs tucked between them. While a single hinge is suitable, a pair of hinges at the right and left sides of the seat portion is preferred.

The hinge contains a chair-position latch for securing the hinge in the chair position. A pair of chair-position latches, one on each hinge, is preferred. The preferred chair-position latch mechanism is a claw 41 and cross bar 42 as best seen in FIGS. 1C and 2C. This mechanism functions as both a latch and a release.

A backpack-position cord 50 is used for raising the seat portion from the chair position to the backpack position, for latching the backpack-position latch to secure the seat portion in the backpack position, and for releasing the backpack-position latch to lower the seat portion from the backpack position to the chair position. The cords run from the backpack-position release on the back legs of the seat portion, up through the upper part of the backrest portion, and to a position where it is easily accessible by the user. In the preferred embodiment shown, the position is above the shoulder straps. The cord preferably includes a handle 51 at its end for ease of gripping. While a single backpack-position cord is suitable, a pair of backpack-position cords is preferred, one for each backpack-position latch.

A chair-position cord 60 is used for raising and lowering the entire apparatus and for releasing the chair-position latch. Releasing the chair-position latch enables the seat portion to pivot from the chair position to the backpack position. The chair-position cord runs from the chair-position latch on the hinge, through a ring (not shown) attached to the shoulder strap, to a position where it is easily accessible by the user. In the preferred embodiment shown, the position is alongside of the shoulder straps. The cord preferably includes a handle 61 at its end for ease of gripping and for retention at the ring. While a single chair-position cord is suitable, a pair of chair-position cords is preferred, one for each chair-position latch.

Many variations are suitable. For example, the backpack-position release and the backpack-position latch are combined if desired. Bushings and other friction and noise reduction components are added as desired.

The use of the preferred embodiment of the combination chair backpack can now be considered. Referring first to FIGS. 1A to 1C, a user is shown sitting in the chair. The hinges are latched in the chair position.

Figure 2B:
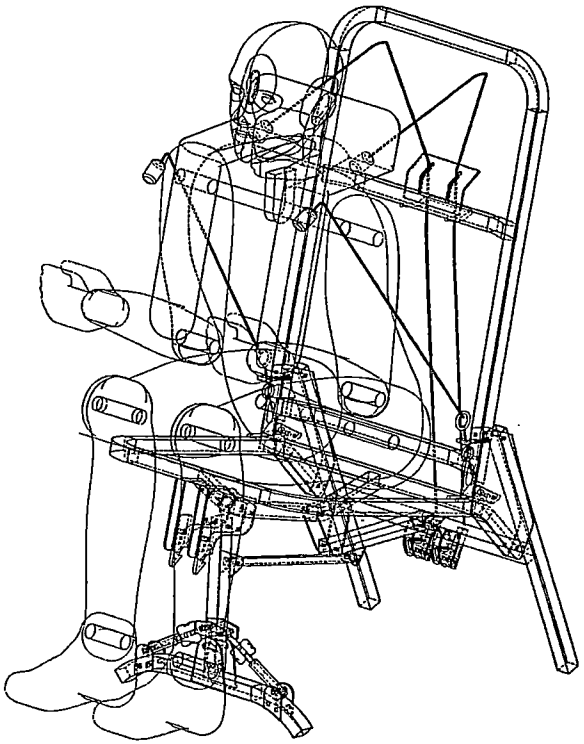
FIG. 2B is a perspective view thereof.
Figure 2A:
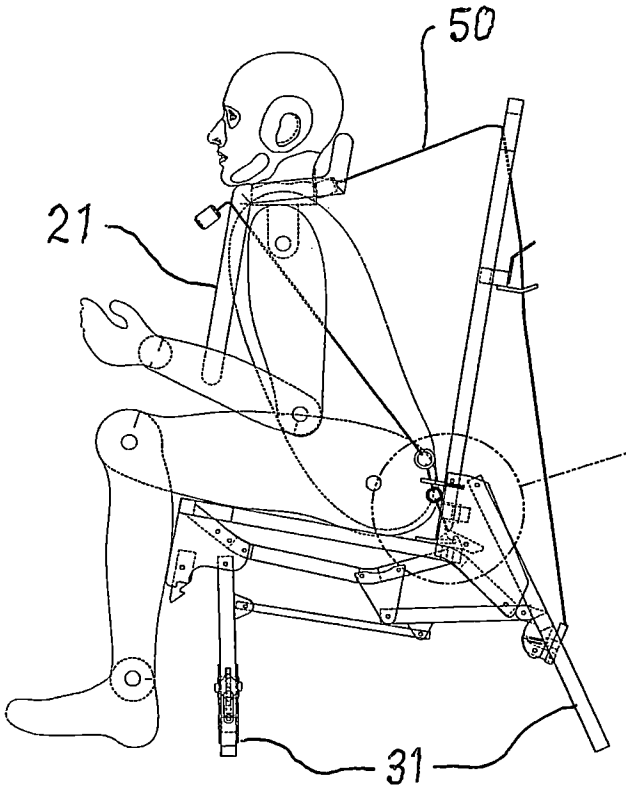
FIG. 2A is a side elevation view thereof with the user leaning forward to pull the chair-position cords.
Figure 2C:
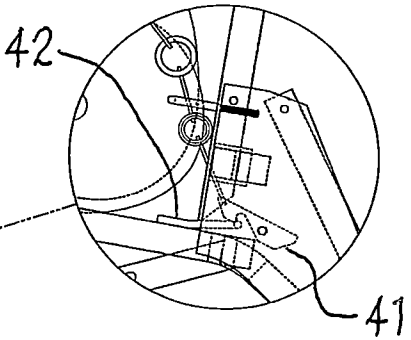
FIG. 2C is a detail of the chair-position latch thereof.

In FIGS. 2A to 2C, the user leans forward and takes his body weight off the seat in preparation for standing up. As the user makes this movement, the pair of chair-position cords are pulled and the chair-position latches on the hinges are released. The release of these latches enables the seat portion to pivot relative to the backrest portion.

Figure 3B:
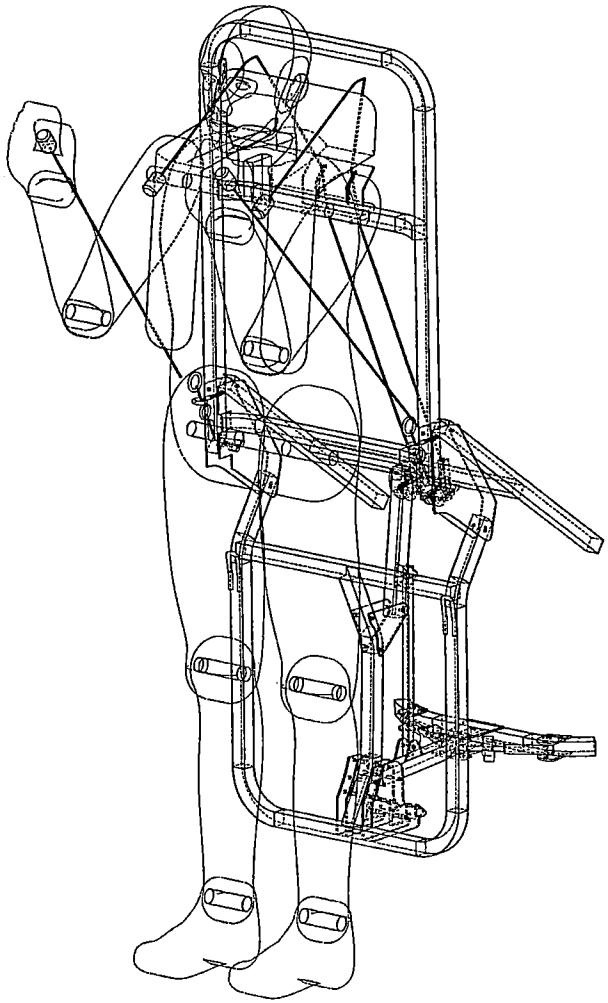
FIG. 3B is a perspective view thereof.
Figure 3A:
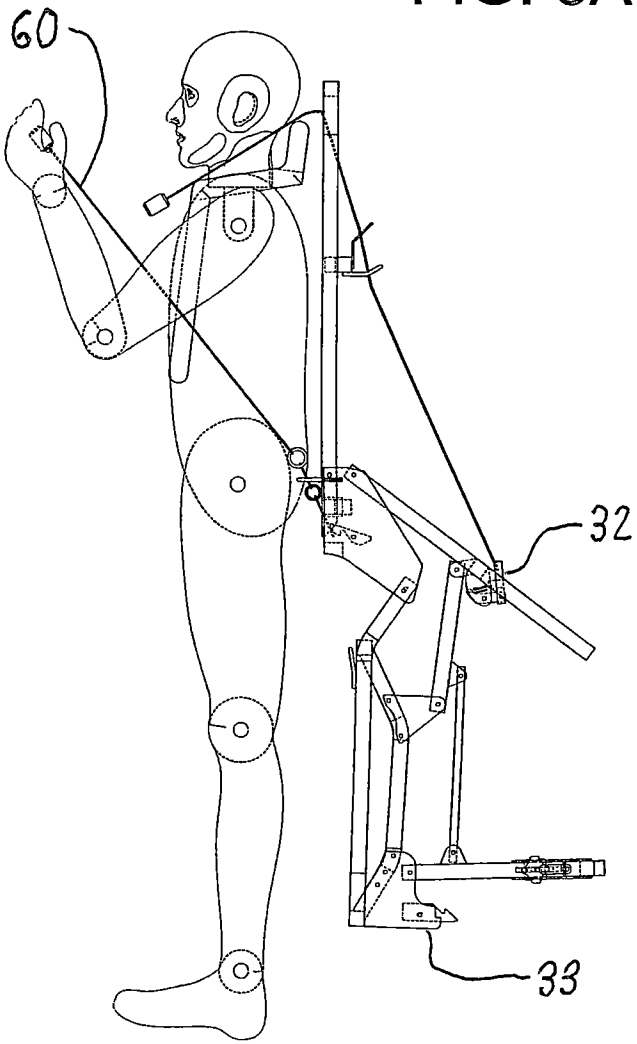
FIG. 3A is a side elevation view thereof with the user standing and pulling the chair-position cords.
Figure 4B:
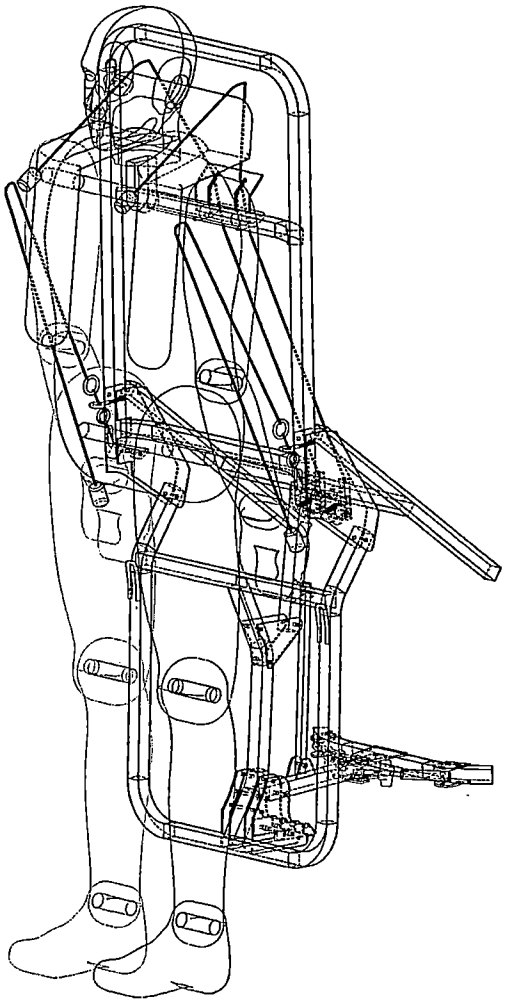
FIG. 4B is a perspective view thereof.
Figure 4A:
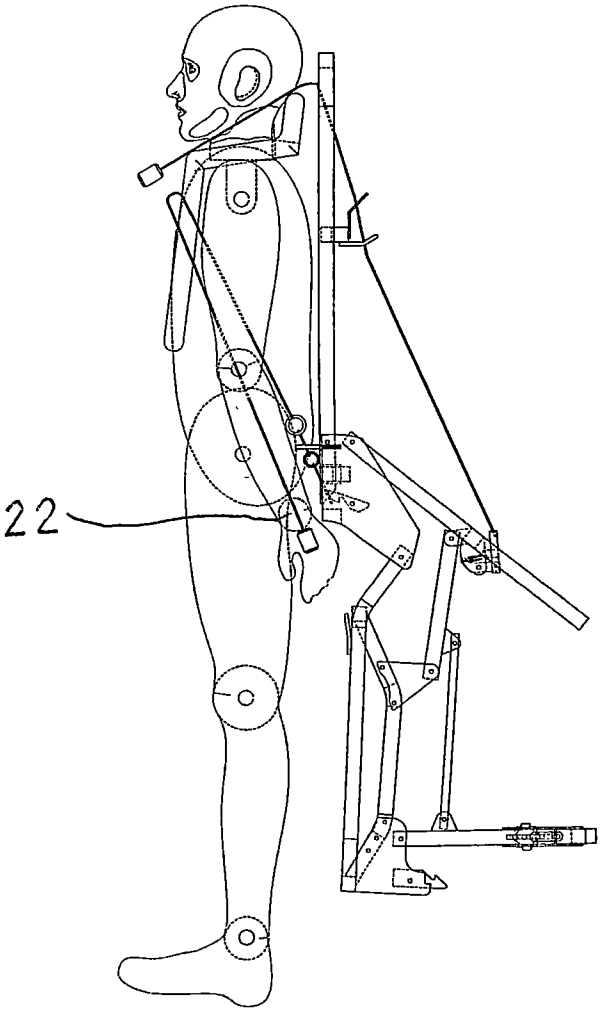
FIG. 4A is a side elevation view thereof with the user securing the chair-position cords.

In FIGS. 3A to 3B, the user stands and pulls the handles on the chair-position cords upwardly and outwardly to pull the entire apparatus upward along the body to a position higher on the back. The higher position is more comfortable for carrying. The chair-position cords are looped over and through the rings on the shoulder straps to support the apparatus in the higher position. The distal ends of the chair-position cords are then placed into cam cleat locks as shown in FIGS. 4A to 4B.

Figure 5B:
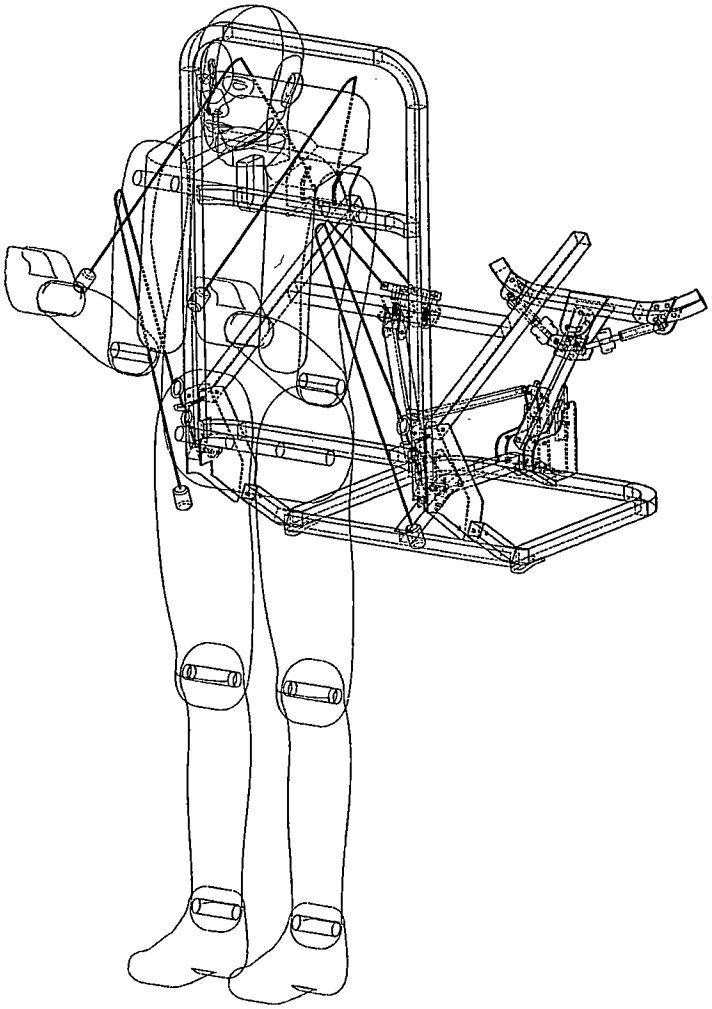
FIG. 5B is a perspective view thereof.
Figure 5A:
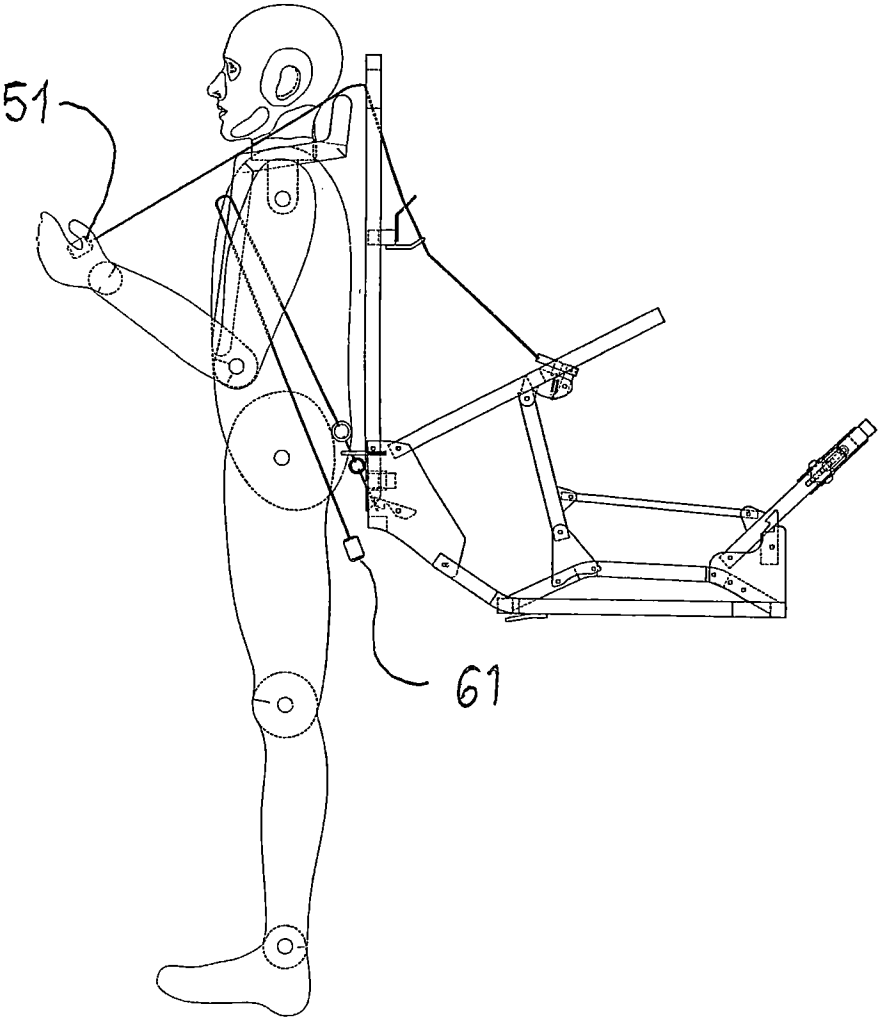
FIG. 5A is a side elevation view thereof with the user pulling the backpack-position cords.

In FIGS. 5A to 5B, the user pulls the handles on the set of backpack-position cords to begin pivoting and raising the seat portion. In FIGS. 6A to 6B, the user fully raises the seat portion to its backpack position where the backpack-position latches engage to secure the seat portion in place. The user is now ready to move to a different location with the combination chair backpack.

The procedure is reversed to convert back to the chair position. The reverse procedure is initiated by jerking the backpack-position cords to engage the backpack-position release which releases the backpack-position latch.

The combination chair backpack is easily and conveniently carried as a backpack. It is easily converted into a chair while on the back of the user rather than requiring the user to manually unfold it while standing beside it. The combination chair backpack is especially useful during hunting. When a hunter is walking through a field or forest with the combination chair backpack in the backpack position and sees game, he is able to convert it to the chair position and then sit down into the chair to aim his weapon or to wait for the game to get closer. As previously discussed, the addition of storage compartments to the seat portion enables the hunter to carry miscellaneous items without the need for a separate backpack.

I claim:

1. A combination chair backpack comprising:

(a) a vertical and stationary backrest portion having a front with shoulder straps for placement over the shoulders of a user and having a back;

(b) a seat portion movable in an arc of about 270 degrees between a vertical backpack position and a horizontal chair position, the seat portion having a top adapted for sitting upon by the user and having a bottom with folding legs;

(c) a backpack-position latch for securing the seat portion in the backpack position and a backpack-position release;

(d) a hinge connecting the backrest portion and the seat portion, the hinge having a backpack position in which the back of the backrest portion is parallel to and facing the bottom of the seat portion, the hinge having a chair position in which the backrest portion is perpendicular to the seat portion;

(e) a chair-position latch for securing the hinge in the chair position and a chair-position release;

(f) a backpack-position cord running from the backpack-position release, through the backrest portion, and to an accessible position for the user for lowering the seat portion from the vertical backpack position to the horizontal chair position, for raising the seat portion from the horizontal chair position to the vertical backpack position to engage the backpack-position latch for securing the seat portion in the backpack position, and for releasing the backpack-position release; and (g) a chair-position cord running from the chair-position latch, through the backrest portion, and to an accessible position for the user for releasing the chair-position latch to enable the seat portion to move from the chair position to the backpack position.

2. The combination chair backpack of claim 1 wherein at least one storage compartment is attached to the seat portion.

* * * * *